US012209365B2

(12) United States Patent
Lai

(10) Patent No.: US 12,209,365 B2
(45) Date of Patent: Jan. 28, 2025

(54) PRODUCTION PROCESS AND APPARATUS FOR ROTATING HUB TYPE PAPER-PLASTIC PRODUCT

(71) Applicant: Changzhou City Cheng Xin Environmental Protection Technology Co., Ltd., Changzhou (CN)

(72) Inventor: Tzung-Shen Lai, Taipei (TW)

(73) Assignee: Changzhou city cheng xin environmental protection technology Co. , Ltd., Changzhou (CN)

( * ) Notice: Subject to any disclaimer, the term of this patent is extended or adjusted under 35 U.S.C. 154(b) by 251 days.

(21) Appl. No.: 17/926,593

(22) PCT Filed: May 21, 2020

(86) PCT No.: PCT/CN2020/091580

§ 371 (c)(1),
(2) Date: Nov. 19, 2022

(87) PCT Pub. No.: WO2021/232357

PCT Pub. Date: Nov. 25, 2021

(65) Prior Publication Data

US 2023/0193564 A1 Jun. 22, 2023

(51) Int. Cl.

| | |
|---|---|
| ***D21J 3/00*** | (2006.01) |
| ***D21J 5/00*** | (2006.01) |
| ***D21J 7/00*** | (2006.01) |

(52) U.S. Cl.
CPC . *D21J 3/00* (2013.01); *D21J 5/00* (2013.01); *D21J 7/00* (2013.01)

(58) Field of Classification Search
CPC ..... D21J 3/00; D21J 5/00; D21J 7/00
See application file for complete search history.

(56) References Cited

U.S. PATENT DOCUMENTS

2015/0267353 A1 9/2015 Lai et al.

FOREIGN PATENT DOCUMENTS

| | | |
|---|---|---|
| CN | 2496913 | 6/2002 |
| CN | 203654091 | 6/2014 |

(Continued)

OTHER PUBLICATIONS

Machine translation of CN205443807, Aug. 10, 2016.

(Continued)

*Primary Examiner* — Jacob T Minskey
*Assistant Examiner* — Matthew M Eslami

(57) ABSTRACT

Provided are a production process for a rotating hub type paper-plastic product, and a device utilizing the production process. The device comprises: a rotating hub forming unit, which can continuously generate a primary blank; an array unit, which forms, by means of an uplink lifting mechanism, a downlink descending mechanism, an uplink array channel and a downlink array channel, a carrier capable of moving in a circulating and reciprocating manner for a profiling jig plate moving in a reciprocating manner thereon; a left forming area unit and a right forming area unit which are respectively arranged at two sides of the array unit and are internally provided with machining areas for a plurality of hot-pressing shaping mechanisms and a plurality of edge cutting mechanisms for use in hot-pressing shaping and edge cutting of the primary blank; a first transfer mechanism and a second transfer mechanism which stretch across the array unit and the left and right forming area units and are provided with a plurality of conveying molds in a suspended manner, so that the primary blank can be transferred; two discharging conveyors which are respectively arranged on the outermost sides of the left and right forming area units; and two defective product conveyors which are arranged between each of the left and right forming area units and (Continued)

each of the discharging conveyors for outputting a defective product which is subjected to screening.

5 Claims, 4 Drawing Sheets

(56) References Cited

FOREIGN PATENT DOCUMENTS

| | | | | |
|---|---|---|---|---|
| CN | 205443807 | | 8/2016 | |
| CN | 205443807 U | * | 8/2016 | ..... D21J 3/00 |
| CN | 107524060 | | 12/2017 | |
| TW | 525361 U | | 7/2016 | |

OTHER PUBLICATIONS

Machine translation of CN203654091, Jun. 18, 2014.
Machine translation of CN2496913, Jun. 26, 2002.
Machine translation of TW525361U, Jul. 11, 2016.
Machine translation of CN107524060, Dec. 29, 2017.

* cited by examiner

PRODUCTION PROCESS AND APPARATUS FOR ROTATING HUB TYPE PAPER-PLASTIC PRODUCT

FIELD OF THE INVENTION

The present invention relates to a production process and an apparatus for rotating hub type paper-plastic product, and more particularly to the production process and the apparatus which is capable of producing the paper-plastic products successively to reduce occupy space of the apparatus and to enhance productivity.

BACKGROUND OF THE INVENTION

At present, products made of pulp fiber materials and/or including plant fiber materials are mixed and beaten as pulp materials, and the pulps are adhered by suction molds, and then the pulps are manufactured in a hot pressing manner. To distinguish it from plastic products, it is generally called "paper-plastic products", or it is also called "molded products" or "pulp molded products". Paper-plastic products have the advantage of being easy to be recycled, remanufactured and reused, which is in line with the trend of environmental protection, recycling and energy saving and carbon reduction. Therefore, it is quickly accepted and willing to use by the business community and the general public. Paper-plastic products, such as bowls, plates, cup lids, packaging materials, shock-absorbing materials, and cushion materials, are gradually being used, and even various products have been tried to be manufactured in the form of paper-plastic products.

The manufacturing production process and process skills of paper-plastic products have been improved and changed frequently in recent years, but the use of fiber materials as the starting material is the basic principle. Regarding the process of manufacturing paper-plastic products, it can be roughly divided into three operations: "suction molding", "drying and dehumidification" and "hot pressing". A suction mold is lowered and immersed in a pulp box filled with pulp, and then a suction device is used to vacuum the slurry in the pulp box through the suction mold, so that the mold surface of the suction mold is formed into a "shell" material layer". When the suction die absorbs the billet layer and rises out of the box, the billet layer is gradually dehumidified due to the continuous suction, and then the suction die together with the billet layer is displaced and extruded with a cold pressing die. Press the primary blank layer to reduce the humidity of the slurry layer and simultaneously shape it into a first primary blank product, which is then removed to complete the "suction molding" operation. Since the primary blanks are still in a relatively medium-high humidity state at this time, the removed primary blanks are immediately sent to a drying area for drying operations. Generally, the hot air drying production process is adopted, so that the primary blanks can be quickly dehumidified and wait for moisture. When the drying rate drops to a relatively low humidity state, it will be removed from the drying area and the "drying and dehumidifying" operation will be completed. The primary blanks removed from the drying area are immediately sent to a "hot pressing and setting mechanism" to perform hot pressing and setting operations on the primary blanks in a relatively low-humidity state, so that they are completely dried and shaped into finished paper-plastic products. Typically, the finished product of the paper-plastic product produced by the hot-pressing setting operation still needs to go through the operations of trimming (removing the overflow), inspection (checking whether the quality is qualified) and packaging (to facilitate the production), but the related operations are omitted.

There are many production processes for paper-plastic products, one of which is the hub-type production process, which is mainly composed of multiple suction mold positions to form a rotatable hub-forming machine, which is driven by power. Having a circular rotation to make multiple suction dies perform suction and extrusion operations at different times to make a preliminary embryo, and then transfer the preliminary embryo for subsequent "drying and dehumidification" and "hot pressing". In this way, through the continuous intermittent rotation of the rotary hub forming machine indexing and time division, the paper-plastic product manufacturing process can be continued.

Referring to FIG. 1, a conventional production process and apparatus for rotating hub type paper-plastic product comprises a hub molding machine 10 configured to suck pulps and molding primary blanks. A worker standing ahead of the hub molding machine 10 moves the primary blanks into a hot air dryer 10 to dry the primary blanks. However, it is time-consuming to dry the primary blanks to slow down delivery of next primary blanks. To overcome aforesaid problem, the primary blanks are delivered in the hot air dryer 11 slowly, so an elongated space is provided to accommodate the hot air dryer 11, and the hub molding machine 1 has to be mate with the hot air dryer 11. After drying the primary blanks, another worker standing ahead of an outlet segment of the hot air dryer 11 moves to a conveyor 12 to distribute subsequent making steps. The primary blanks are move into two arcuate conveyors 12 from the hit air dryer 11 to execute the subsequent making steps. Thereafter, the primary blanks are moved into an abnormal sorting conveyor 13 to be treaded to comply with making requirements. The primary blanks are delivered into a hot pressing mechanism 14 to be hot pressed to produce the paper-plastic products. Finally, the paper-plastic products are conveyed to a stacker 15 to be stacked in a certain quantity and are transferred to a packaging zone to be packaged.

Nevertheless, the hot air dryer 2 is provided in the conventional production process to reduce moisture content of the primary blanks, thus occupying a space of the factory. Furthermore, it is time-consuming to dry the primary blanks by slowing suction time of the pulps, thus decreasing productivity and increasing production cost. Also, the conventional production process cause high consumption of labors and energy and low intellectual production at a high cost.

The present invention has arisen to mitigate and/or obviate the afore-described disadvantages.

SUMMARY OF THE INVENTION

The primary aspect of the present invention is to provide a production process and an apparatus for rotating hub type paper-plastic product by which reduce an occupy space of the apparatus and to enhance a space utilization.

Another aspect of the present invention is to provide a production process and an apparatus for rotating hub type paper-plastic product by which steps of the production process are intellectual to decrease energy and labor consumption, thus enhancing productivity and reducing production cost.

To obtain abovementioned aspects, an apparatus for rotating hub type paper-plastic product provided by the present invention contains: a rotating hub forming unit, an array unit, a left forming area unit, a right forming area unit, a first transfer mechanism, a second transfer mechanism, a discharging conveyor, and a defective product conveyor.

The rotating hub forming unit is a start end of the apparatus and is configured to produce primary blanks successively. The array unit includes a uplink lifting mechanism, a downlink descending mechanism, multiple upper rails and multiple lower rails so as to carry the primary blanks and to move multiple profiling jigs reciprocately. The left forming area unit and the right forming area unit are fixed beside the array unit, and the left forming area unit and the right forming area unit are a working zone in which multiple hot pressing mechanisms and multiple cutting mechanisms are arranged to hot press and cut the primary blanks. The first transfer mechanism and the second transfer mechanism extend across the array unit, the left forming area unit and the right forming area unit. The first transfer mechanism and the second transfer mechanism includes multiple conveying molds hang on two sides of the first transfer mechanism and the second transfer mechanism and configured to deliver the primary blanks. The two discharging conveyors are connected outside the left forming area unit and the right forming area unit and are configured to output the paper-plastic products. The two defective product conveyors are defined among the left forming area unit, the right forming area unit, and the two discharging conveyors and are configured to collect defective paper-plastic products.

Preferably, the apparatus further contains the multiple profiling jigs which are configured to receive and carry the primary blanks.

Preferably, the multiple the multiple profiling jigs move simultaneously and upward or downward so that the primary blanks are delivered to be hot pressed and cut.

A production process for rotating hub type paper-plastic product provided by the present invention contains steps of:

(1) driving a rotating hub forming unit by a power source to rotate successively, wherein the rotating hub forming unit presses pulps to produce the primary blanks and sucks another pulps simultaneously;

(2) dropping the primary blanks on multiple profiling jigs of multiple upper rails of a uplink lifting mechanism of an array unit so that the multiple profiling jigs deliver the primary blanks to locate below a first transfer mechanism along the multiple upper rails of the array unit;

(3) carrying the primary blanks of the multiple profiling jigs by using multiple conveying molds of a first transfer mechanism to a left forming area unit and a right forming area unit horizontally;

(4) further carrying the primary blanks to multiple hot pressing mechanisms and multiple cutting mechanisms of the left forming area unit and multiple hot pressing mechanisms and multiple cutting mechanisms of the right forming area unit horizontally, two discharging conveyors or the two defective product conveyors by using the multiple conveying molds of the first transfer mechanism so as to hot press, cut, and output the paper-plastic products or to collect the defective plastic-paper products;

(5) longitudinally moving the multiple profiling jigs of the multiple upper rails of the uplink lifting mechanism forward to a downlink descending mechanism so as to be moved downward on the multiple upper rails of the uplink lifting mechanism, then moving the multiple profiling jigs backward to the uplink lifting mechanism via the multiple lower rails of the uplink lifting mechanism, thus receiving next primary blanks;

(6) sucking another pulps and pressing the pulps by way of the rotating hub forming unit when delivering the next primary blanks in a next working position, and conveying the next primary blanks to the multiple profiling jigs so that the multiple profiling jigs longitudinally move the next primary blanks forward along the multiple upper rails of the array unit;

(7) moving the next primary blanks to locate below a second transfer mechanism via the first transfer mechanism so that multiple conveying molds of the second transfer mechanism further deliver the next primary blanks horizontally to the left forming area unit, the right forming area unit, the two discharging conveyors or the two defective product conveyors from the multiple profiling jigs;

(8) moving the hot pressing mechanism and the cutting mechanism of the left forming area unit and the right forming area unit to another next working position, when the next primary blanks are moved to multiple conveying molds of the first transfer mechanism and the multiple conveying molds of the second transfer mechanism from the multiple profiling jigs, wherein the next primary blanks are moved in a path which is sucking and pressing the pulps, moving the next primary blanks by using the array unit, the first transfer mechanism and the second transfer mechanism, molding and cutting the next primary blanks in the left forming area unit and the right forming area unit, and conveying the next primary blanks to the two discharging conveyors or the two defective product conveyors; and (9) moving next multiple profiling jigs to the first transfer mechanism longitudinally after the next multiple profiling jigs carry another next primary blanks, and automatically selecting whether delivering another next primary blanks by using the first transfer mechanism, wherein when the first transfer mechanism is unable to deliver said another next primary blanks, the next multiple profiling jigs move to the second transfer mechanism.

Preferably, when some multiple conveying molds of the first transfer mechanism deliver the primary blanks, the other of the multiple conveying molds of the first transfer mechanism horizontally move to a next working position simultaneously, thus delivering, pressing, and cutting the primary blanks simultaneously.

Preferably, the multiple profiling jigs move reciprocately in the array unit to receive the next primary blanks and to deliver the primary blanks longitudinally, thus delivering and producing various primary blanks simultaneously.

Preferably, multiple left forming area units and multiple right forming area units are fixed on different apparatus in different quantities, and multiple first transfer mechanisms and multiple second transfer mechanisms are arranged to mate with the using requirements, thus enhancing productivity quickly.

DETAILED DESCRIPTION OF THE PREFERRED EMBODIMENTS

Figure 1:
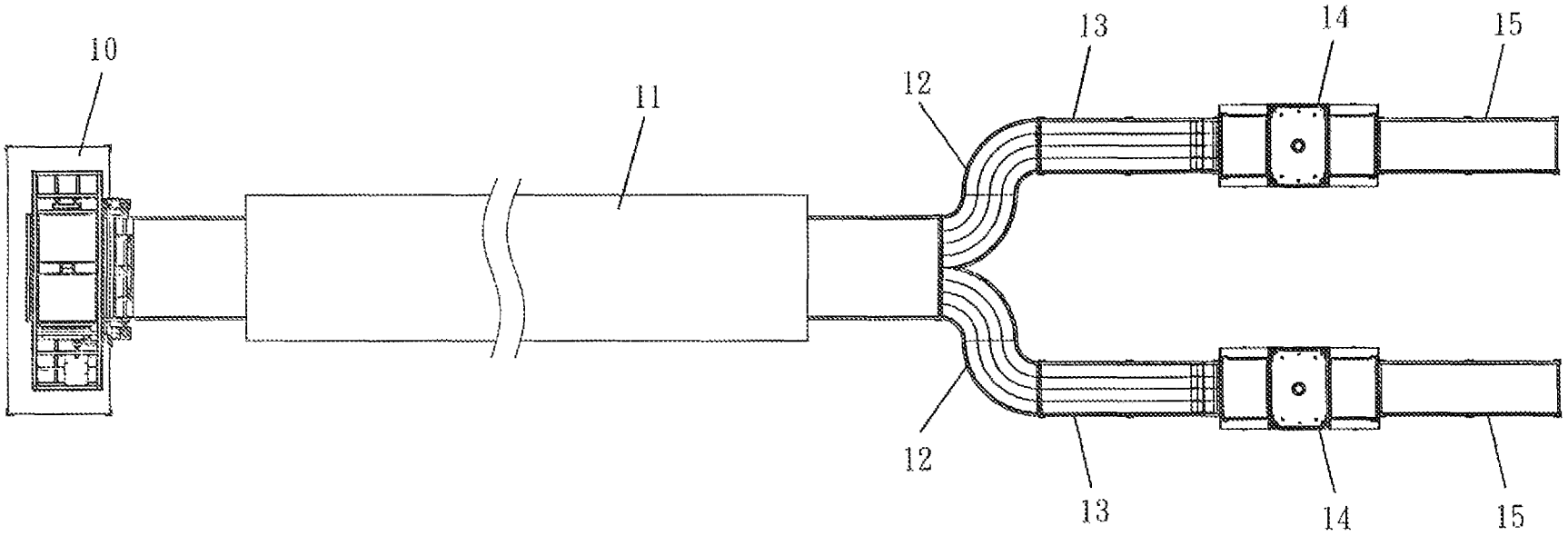
FIG. 1 is a schematic view showing the operation of a conventional production process and apparatus for rotating hub type paper-plastic product.
Figure 2:
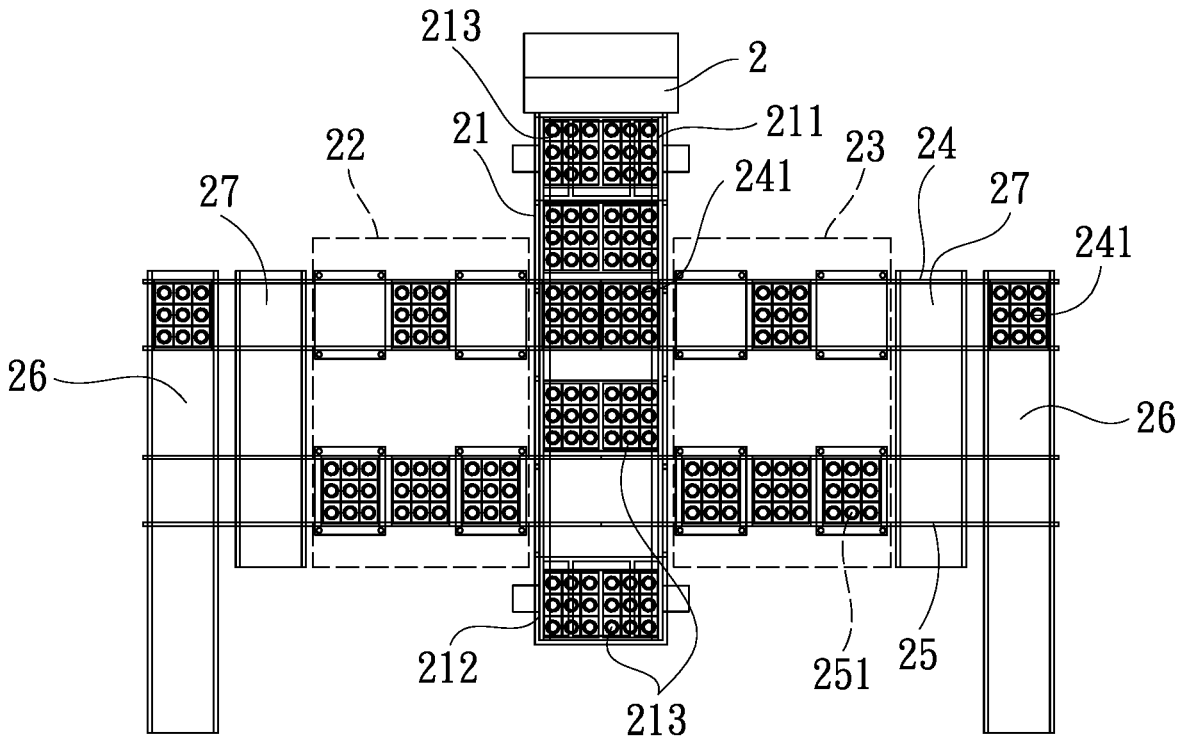
FIG. 2 is a schematic view showing the operation of a production process and an apparatus for rotating hub type paper-plastic product according to a preferred embodiment of the present invention.
Figure 3:
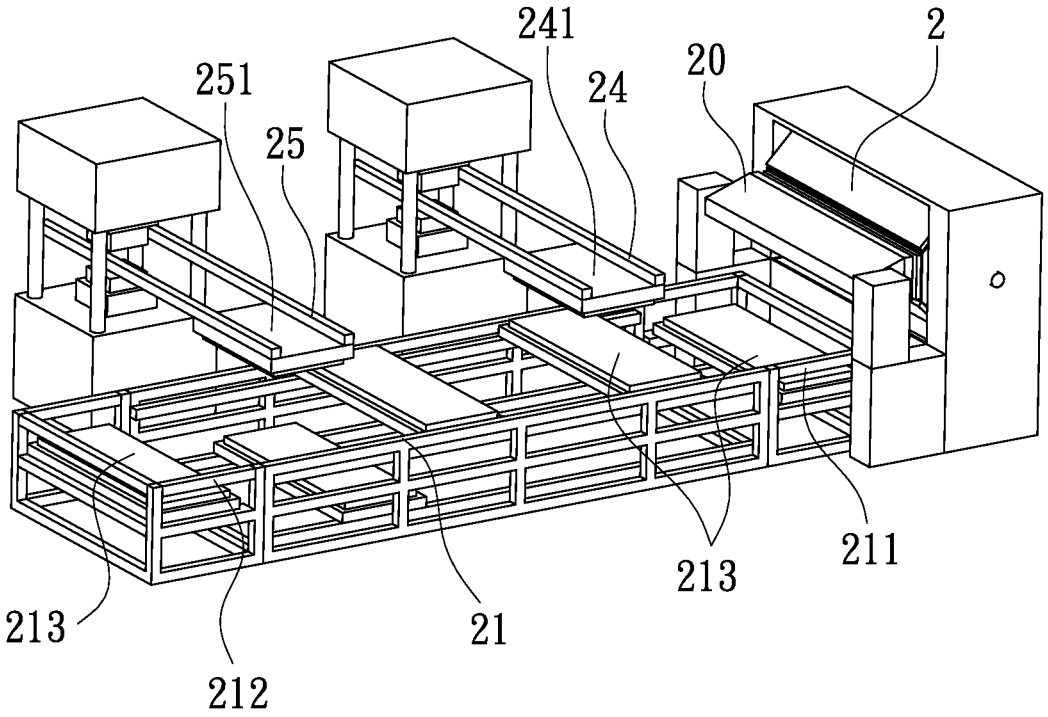
FIG. 3 is a perspective view showing the operation of a part of the production process and the apparatus according to the preferred embodiment of the present invention.
Figure 4:
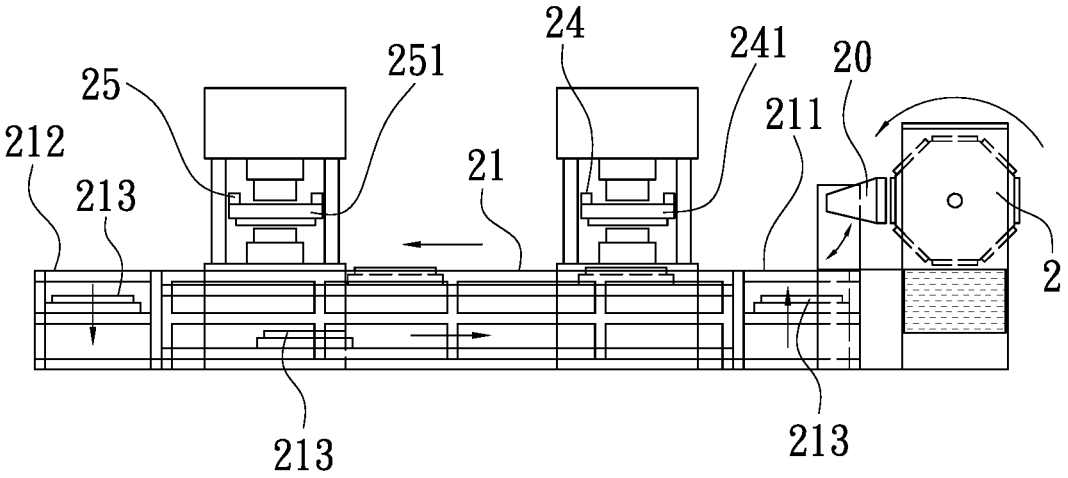
FIG. 4 is a plan view of FIG. 3.

FIGS. 2-4 are schematics views showing a production process and an apparatus according to a preferred embodiment of the present invention.

The apparatus comprises: a rotating hub forming unit 2, an array unit 21, a left forming area unit 22, a right forming area unit 23, a first transfer mechanism 24, a second transfer mechanism 25, two discharging conveyors 26, and two defective product conveyors 27. The rotating hub forming unit 2 is a start end of the apparatus and is configured to suck and to press pulps, thus producing primary blanks. The rotating hub forming unit 2 includes multiple molds arranged therein and is a well-known art, so further remarks are omitted. The array unit 21 is connected on the rotating hub forming unit 2 and is arranged longitudinally, the array unit 21 includes a uplink lifting mechanism 211 fixed on a first end thereof adjacent to the rotating hub forming unit 2 and configured to move upward and downward, when the uplink lifting mechanism 211 is lifted upward to a top of the apparatus, the uplink lifting mechanism 211 receives the primary blanks which are removed from a removal mold 20 of the rotating hub forming unit 2, and the array unit 21 includes a downlink descending mechanism 212 fixed on a second end thereof and configured to move upward and downward, multiple upper rails and multiple lower rails which are arranged on a middle section of the array unit 21, wherein the multiple lower rails are located below the multiple upper rails, and multiple profiling jigs 213 are configured to move on the multiple upper rails and the multiple lower rails of the array unit 21, wherein the multiple profiling jigs 213 move forward via the uplink lifting mechanism 211 to return back to an original position via the downlink descending mechanism 212, thus moving the multiple profiling jigs 213 longitudinally and reciprocately. The left forming area unit 22 is a working zone in which multiple hot pressing mechanisms and multiple cutting mechanisms are arranged, wherein the hot pressing mechanism and the cutting mechanism of the left forming area unit 22 are mounted in the working zone horizontally in multiple horizontal arrangements beside the array unit 21, such that the primary blanks are hot pressed and cut by the multiple hot pressing mechanisms and the multiple cutting mechanisms of the left forming area unit 22. The right forming area unit 23 is a working zone in which multiple hot pressing mechanisms and multiple cutting mechanisms are arranged, wherein the hot pressing mechanism and the cutting mechanism of the right forming area unit 23 are mounted in the working zone horizontally in multiple horizontal arrangements beside the array unit 21, wherein the hot pressing mechanism and the cutting mechanism of the right forming area unit 23 and the hot pressing mechanism and the cutting mechanism of the left forming area unit 22 are on a same horizontal level, such that the primary blanks are hot pressed and cut by the multiple hot pressing mechanisms and the multiple cutting mechanisms of the right forming area unit 23. The first transfer mechanism 24 is disposed adjacent to the rotating hub forming unit 2 and extends across the array unit 21 horizontally, the left forming area unit 22, the right forming area unit 23, the two discharging conveyors 26 and the two defective product conveyors 27, wherein the first transfer mechanism 24 includes multiple conveying molds 241 hang on two sides thereof and configured to convey the primary blanks and the paper-plastic products. The second transfer mechanism 25 is mounted away from the rotating hub forming unit 2 and extends across the array unit 21 horizontally, the left forming area unit 22, the right forming area unit 23, the two discharging conveyors 26, and the two defective product conveyors 27, wherein the second transfer mechanism 25 includes multiple conveying molds 251 hang on two sides thereof and configured to convey the primary blanks and the paper-plastic products. The first transfer mechanism 24 and the second transfer mechanism 25 are parallel. The two discharging conveyors 26 are connected outside the left forming area unit 22 and the right forming area unit 23 and are configured to output the paper-plastic products. The two defective product conveyors 27 are defined among the left forming area unit 22, the right forming area unit 23, and the two discharging conveyors 26 and are configured to collect defective paper-plastic products.

Thereby, the paper-plastic products are made by the apparatus based on steps of:

(1) driving the rotating hub forming unit 2 by a power source to rotate successively, wherein the rotating hub forming unit 2 presses the pulps to produce the primary blanks and sucks another pulps simultaneously;

(2) dropping the primary blanks on the multiple profiling jigs 213 of the multiple upper rails of the uplink lifting mechanism 211 of the array unit 21 so that the multiple profiling jigs 213 deliver the primary blanks to locate below the first transfer mechanism 24 along the multiple upper rails of the array unit 21;

(3) carrying the primary blanks of the multiple profiling jigs 213 by using the multiple conveying molds 241 of the first transfer mechanism 24 to the left forming area unit 22 and the right forming area unit 23 horizontally;

(4) further carrying the primary blanks to the multiple hot pressing mechanisms and the multiple cutting mechanisms of the left forming area unit 22 and the multiple hot pressing mechanisms and the multiple cutting mechanisms of the right forming area unit 23 horizontally, the two discharging conveyors 26 or the two defective product conveyors 27 by using the multiple conveying molds 241 of the first transfer mechanism 24 so as to hot press, cut, and output the paper-plastic products or to collect the defective plastic-paper products;

(5) longitudinally moving the multiple profiling jigs 213 of the multiple upper rails of the uplink lifting mechanism 211 forward to the downlink descending mechanism 212 so as to be moved downward on the multiple upper rails of the uplink lifting mechanism 211, then moving the multiple profiling jigs 213 backward to the uplink lifting mechanism 211 via the multiple lower rails of the uplink lifting mechanism 211, thus receiving next primary blanks;

(6) sucking another pulps and pressing the pulps by way of the rotating hub forming unit 2 when delivering the next primary blanks in a next working position, and conveying the next primary blanks to the multiple profiling jigs 213 so that the multiple profiling jigs 213 longitudinally move the next primary blanks forward along the multiple upper rails of the array unit 21;

(7) moving the next primary blanks to locate below the second transfer mechanism 25 via the first transfer mechanism 24 so that the multiple conveying molds 251 of the second transfer mechanism 25 further deliver the next primary blanks horizontally to the left forming area unit 22, the right forming area unit 23, the two discharging conveyors 26 or the two defective product conveyors 27 from the multiple profiling jigs 213;

(8) moving the hot pressing mechanism and the cutting mechanism of the left forming area unit 22 and the right forming area unit 23 to another next working position, when the next primary blanks are moved to the multiple conveying molds 241 and the multiple conveying molds 251 from the multiple profiling jigs 213, wherein the next primary blanks are moved in a path which is sucking and pressing the pulps, moving the next primary blanks by using the array unit, the first transfer mechanism 24 and the second transfer mechanism 25, molding and cutting the next primary blanks in the left forming area unit 22 and the right forming area unit 23, and conveying the next primary blanks to the two discharging conveyors 26 or the two defective product conveyors 27;

(9) moving next multiple profiling jigs 213 to the first transfer mechanism 24 longitudinally after the next multiple profiling jigs 213 carry another next primary blanks, and automatically selecting whether delivering another next primary blanks by using the first transfer mechanism 24, wherein when the first transfer mechanism 24 is unable to deliver said another next primary blanks, the next multiple profiling jigs 213 move to the second transfer mechanism 25.

Thereby, the rotating hub forming unit 2 is rotated reciprocately to suck the new pulps successively and to press the pulps in the next working position so as to mold the primary blanks quickly. The multiple profiling jigs 213 of the array unit 21 move longitudinally and reciprocately and deliver the primary blanks of the rotating hub forming unit 2 to the left forming area unit 22 and the right forming area unit 23 so as to hot press, cut, output various paper-plastic products produced in different times and to collect the defective paper-plastic products efficiently. Preferably, multiple left forming area units 22 and multiple right forming area units 23 are fixed on different apparatus in different quantities and arrangements based on using requirements, and multiple first transfer mechanisms 24 and multiple second transfer mechanisms 25 are arranged to mate with the using requirements, thus enhancing productivity and a space utilization easily. The apparatus of the present invention is arranged in a compact and crisscross delivery manner to reduce an occupy space of the apparatus and to enhance the space utilization.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. An apparatus for forming a paper-plastic product, the apparatus comprising:

a rotating hub forming unit being at a start end of the apparatus and configured to produce primary blanks successively;

an array unit including an uplink lifting mechanism, a downlink descending mechanism, multiple upper rails, multiple lower rails, and multiple profiling jigs configured to receive and carry the primary blanks, the multiple profiling jigs simultaneously movable on the uplink lifting mechanism, the downlink descending mechanism, the upper rails, or the lower rails so as to carry the primary blanks so that the primary blanks are delivered to be hot pressed and cut;

a left forming area unit and a right forming area unit which are fixed beside the array unit, the left forming area unit and the right forming area unit comprising a working zone in which multiple hot pressing mechanisms and multiple cutting mechanisms are arranged to hot press and cut the primary blanks;

a first transfer mechanism and a second transfer mechanism which each extend from the array unit to the left forming area unit and the right forming area unit, the first transfer mechanism and the second transfer mechanism including multiple conveying molds extending from two sides of the first transfer mechanism and the second transfer mechanism and configured to deliver the primary blanks;

two discharging conveyors disposed outside the left forming area unit and the right forming area unit and configured to output paper-plastic products; and two defective product conveyors disposed among the left forming area unit, the right forming area unit, and the two discharging conveyors and configured to collect defective paper-plastic products.

2. A production process for a paper-plastic product comprising steps of:

(1) driving a rotating hub forming unit by a power source to rotate successively, wherein the rotating hub forming unit presses pulp to produce primary blanks and sucks additional pulp simultaneously;

(2) dropping the primary blanks on multiple profiling jigs of multiple upper rails of a uplink lifting mechanism of an array unit so that the multiple profiling jigs deliver the primary blanks to a location below a first transfer mechanism along the multiple upper rails of the array unit;

(3) carrying the primary blanks of the multiple profiling jigs by using multiple conveying molds of the first transfer mechanism to a left forming area unit and a right forming area unit horizontally;

(4) further carrying the primary blanks to multiple hot pressing mechanisms and multiple cutting mechanisms of the left forming area unit and multiple hot pressing mechanisms and multiple cutting mechanisms of the right forming area unit horizontally, and carrying paper-plastic products to two discharging conveyors or two defective product conveyors, by using the multiple conveying molds of the first transfer mechanism so as to hot press, cut, and output the paper-plastic products and to collect the defective plastic-paper products;

(5) longitudinally moving the multiple profiling jigs of the multiple upper rails of the uplink lifting mechanism forward to a downlink descending mechanism so as to be moved downward from the multiple upper rails of the uplink lifting mechanism, then moving the multiple profiling jigs backward to the uplink lifting mechanism via the multiple lower rails of the uplink lifting mechanism, thus receiving next primary blanks;

(6) sucking additional pulp and pressing the additional pulp by way of the rotating hub forming unit to deliver the next primary blanks in a next working position, and conveying the next primary blanks to the multiple profiling jigs so that the multiple profiling jigs longitudinally move the next primary blanks forward along the multiple upper rails of the array unit;

(7) moving the next primary blanks to a location below a second transfer mechanism past the first transfer mechanism so that multiple conveying molds of the second transfer mechanism further deliver the next primary blanks horizontally to the left forming area unit, the right forming area unit, the two discharging conveyors or the two defective product conveyors from the multiple profiling jigs;

(8) moving the hot pressing mechanism and the cutting mechanism of the left forming area unit and the right forming area unit to another next working position, when the next primary blanks are moved to the multiple conveying molds of the first transfer mechanism or the multiple conveying molds of the second transfer mechanism from the multiple profiling jigs, wherein the next primary blanks are moved in a path which comprises sucking and pressing of pulp, moving the next primary blanks by using the array unit, the first transfer mechanism or the second transfer mechanism, molding and cutting the next primary blanks in the left forming area unit and the right forming area unit, and conveying the next primary blanks to the two discharging conveyors or the two defective product conveyors; and (9) moving the multiple profiling jigs to the first transfer mechanism longitudinally after the multiple profiling jigs carry another next primary blanks, and automatically selecting delivery of the another next primary blanks by using the first transfer mechanism, wherein when the first transfer mechanism is unable to deliver said another next primary blanks, the multiple profiling jigs move to the second transfer mechanism.

3. The production process as claimed in claim 2, wherein when some multiple conveying molds of the first transfer mechanism deliver the primary blanks, other of the multiple conveying molds of the first transfer mechanism horizontally move to a next working position simultaneously, thus delivering, pressing, and cutting the primary blanks simultaneously.

4. The production process as claimed in claim 2, wherein the multiple profiling jigs move reciprocatingly in the array unit to receive the next primary blanks and to deliver the next primary blanks longitudinally, thus delivering and producing primary blanks simultaneously.

5. The production process as claimed in claim 2, wherein multiple left forming area units and multiple right forming area units are fixed on different apparatus in different quantities, and multiple first transfer mechanisms and multiple second transfer mechanisms are arranged to mate in accordance with usage requirements.

* * * * *